United States Patent [19]

Oeda

[11] 4,355,070

[45] Oct. 19, 1982

[54] HEAT-SENSITIVE RECORD MATERIAL

[75] Inventor: Yoshitaka Oeda, Nara, Japan

[73] Assignee: Kanzaki Paper Manufacturing Co., Ltd., Tokyo, Japan

[21] Appl. No.: 211,655

[22] Filed: Dec. 1, 1980

[51] Int. Cl.[3] ..... B41M 5/18

[52] U.S. Cl. ..... 428/323; 282/27.5; 427/150; 427/151; 427/220; 428/320.8; 428/328; 428/329; 428/331; 428/341; 428/342; 428/537; 428/913

[58] Field of Search ..... 282/27.5; 427/150, 151, 427/212, 215, 218, 220, 221; 428/307, 323, 331, 341, 342, 411, 537, 913, 914, 320.4, 320.6, 320.8, 328, 329, 330, 488, 531

[56] References Cited

U.S. PATENT DOCUMENTS 3,894,168 7/1975 Brockett et al. ..... 428/537 X

*Primary Examiner*—Bruce H. Hess

*Attorney, Agent, or Firm*—Morgan, Finnegan, Pine, Foley & Lee

[57] ABSTRACT

The color developing layer of a heat-sensitive record material comprising (a) electron donating color forming material, (b) acceptor which is reactive with said color forming material to develop a color, (c) a heat fusible material having a melting point with in the range of 60° C. to 200° C., and (d) oil absorptive pigment having an oil absorption within the range of at least 80 ml/100 g said pigment existing in said color developing layer in the form of finely divided particles each having a coating thereon, said coating being formed of said color forming material, said acceptor or said heat fusible material.

7 Claims, No Drawings

HEAT-SENSITIVE RECORD MATERIAL

BACKGROUND OF THE INVENTION

This invention relates to a heat-sensitive record material and particularly to a heat-sensitive record material which is adapted for a high speed and unremitting recording so that it may find its usefulness as a recording medium for information machines and instruments such as facsimiles, electronic computers and telex machines.

There is known a heat-sensitive record material comprising a base sheet having a color developing layer which includes finely divided particles of one of electron donating color forming materials (hereinafter referred to as "color former") such as triphenylmethane compounds, fluoran compounds, phenothiazine compounds, auramine compounds and spiropyran compounds and finely divided particles of one of organic acceptors such as phenolic compounds, aromatic carboxylic acids and their polyvalent metal salts and/or one of inorganic acceptors such as activated clay, acid clay, attapulgite, aluminum silicate and talc. In such the heat-sensitive record material like this the above mentioned two kinds of particles are, when at least one of them is melted or sublimated at an elevated temperature, brought into intimate contact with each other to develop a color.

One of the most typical heat transmission systems for developing a color image on the above mentioned heat-sensitive record material is to transfer heat to the heat-sensitive record material through the utilization of a thermal head having a number of electric resistance heating elements through which Joule heat produced by electric current pulses in response to signals to be recorded can be transmitted to the surface of the heat-sensitive record material when the thermal head is into close contact with the heat-sensitive record material. An inevitable trouble with this type of heat transmission is the fact that the color developing material which is in a melted state when heated is transferred and adhered as smudges or tailings to the thermal head. The smudges or tailings adhered to the thermal head gradually and steadily grow during a continuous recording operation with the result that the thermal conductivity from the thermal head to the heat-sensitive record material is reduced. This is apparently disadvantageous since clear and distinct color images can never be expected at a high speed recording.

Another trouble involved with the above mentioned heat transmission system is the fact that the heat-sensitive record material is liable to be stuck in contact with the thermal head to which heat is transferred. This "sticking" prevents the heat-sensitive record material from being smoothly fed in a constant speed. This after results in irregularly leaving space between the typing lines, deforming the record images, interrupting the recording and damaging the thermal head.

With an attempt to avoid the above mentioned disadvantage it has been proposed in Japan Kokai (Laid-Open Patent Publication) No. 33,832 of 1973 and U.S. Pat. No. 3,859,112 to add to the color developing layer conventioned inorganic pigments such as clay, talc, calcium carbonate and titanium oxide. In order to substantially avoid adhesion of smudges or tailings, however those conventional inorganic pigments must be used in such an extremely large amount that the image density is lowered.

Another attempt to prevent adhesion of smudges or tailings to the thermal head and "sticking" between the heat-sensitive record material and the thermal head is to increase the amount of the binder used in the color developing layer. This attempt has also involved the lowering of the image density.

A further attempt made by the inventor et al to avoid the above mentioned disadvantages is to add to the color developing layer of a heat-sensitive record material a pigment having a large oil absorption which is capable of effectively absorbing color developing materials, as disclosed in Japan Kokai (Laid-Open Patent Publication) No. 86,229 of 1978 and U.S. Pat. No. 4,168,845. In this manner the thermal head can be protected from smudges without sacrificing the record image density and recording operation can be carried out at a relatively high speed without stopping for a relatively long time.

However, recently a further high speed recording has been required in information machines and instruments such as facsimiles, electronic computers and telex machines in which the heat-sensitive record material is used as a recording medium. This also requires that the printing time of the thermal head on the heat-sensitive record material for recording is extremely shortened. In such a extremely high speed recording like this a satisfactory continuous recording can not be expected even with the utilization of the above mentioned pigment having a large oil absorption. Increasing the amount of the pigment having a large oil absorption involves a disadvantages of lowering the image density.

The primary object of the invention is to provide an improved heat-sensitive record material which can prevent the thermal head from being smudged and stuck without sacrificing the record image density and the recording sensitivity.

Another object of its invention is to provide an improved heat-sensitive record material which can satisfactorily meet the requirements of recording machines and implements in which continuous recording for a long time is carried out at an extremely high speed.

Other objects and advantages of the invention will be apparent from the following detailed description.

SUMMARY OF THE INVENTION

In order to achieve the above mentioned objects of the invention, the color developing layer formed on at least one surface of the base sheet of the heat-sensitive record material comprises:

(a) color former, (b) acceptor which is reactive with said color former to develop a color, (c) a heat fusible material having a melting point within the range of 60° C. to 200° C., and (d) oil absorptive pigment having an oil absorption within the range of at least 80 ml/100 g.

According to the invention, the oil absorptive pigment exists in the color developing layer in the form of finely divided particles each having a coating thereon, said coating being formed of said color former, said acceptor or said heat fusible material. The coating on the oil absorptive pigment may also include both the color former and the heat fusible material or both the acceptor and the heat fusible material, but it may not include both the color former and the acceptor. Typically, the color former which is electron color forming material may be colorless chromogenic material.

DETAILED DESCRIPTION OF THE INVENTION

Various combinations for the (a) color former and the (b) acceptor may be utilized. Among them there are included the combination of a basic colorless chromogenic material with an organic or inorganic acceptor, the combination of a metal salt of a long chain fatty acid such as ferric stearate or ferric myristate with a phenolic compound such as tannic acid or gallic acid.

Among useful basic colorless chromogenic materials, there are included, by way of examples, 3,3-bis(p-dimethylaminophenyl)-6-dimethylaminophthalide (CVL), 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis-(1,2-dimethylindole-3-yl)-5-dimethylaminophthalide, 3,3-bis-(1,2-dimethylindole-3-yl)-6-dimethylaminophthalide, 3,3-bis-(9-ethylcarbazole-3-yl)-5-dimethylaminophthalide, 3,3-bis-(2-phenylindole-3-yl)-5-dimethylaminophthalide, 3-p-dimethylaminophenyl-3-(1-methylpyrrole-2-yl)-6-dimethylaminophthalide, 4,4'-bis-dimethylaminobenzhydrinebenzylether, N-halophenyl-leucoauramine, N-2,4,5-trichlorophenyl-leucoauramine, rhodamine-B-anilinolactam, rhodamine-(p-nitroanilino)lactam, rhodamine-(p-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2, 3-dimethylfluoran, 7-diethylamino-(3-acetylmethylamino)fluoran, 7-diethylamino-(3-methylamino)fluoran, 3,7-diethylaminofluoran, 7-diethylamino-3-(dibenzylamino)fluoran, 7-diethylamino-3-(methylbenzylamino)fluoran, 7-diethylamino-3-(chloroethylmethylamino)fluoran, 7-diethylamino-3-(diethylamino)fluoran, 2-phenylamino-3-methyl-6-(N-ethyl-N-p-toluyl)amino-fluoran, benzoyl-leucomethyleneblue, p-nitrobenzyl-leucomethylene blue, 3-methyl-spiro-dinaphtopyrane, 3-ethyl-spiro-dinaphthopyrane, 3,3'-dichloro-spiro-dinaphthopyrane, 3-benzylspiro-dinaphthopyrane, 3-methyl-naphtho-(3-methoxy-benzo)-spiropyrane and 3-propyl-spiro-dibenzopyrane. The above colorless chromogenic material may be used either solely or in combination.

The acceptor as the other reactant of the heat-sensitive record material according to the invention may be either organic or inorganic.

Among organic acceptors there are included phenolic compounds, aromatic carboxylic acids and their polyvalent metal salt.

Typical phenolic compounds which can be used as acceptor are: 4-tert-butylphenol, 4-hydroxydiphenoxide, α-naphthol, β-naphthol, 4-hydroxyacetophenol, 4-tert-octylcatechol, 2,2'dihydroxydiphenol, 2,2'-methylene-bis(4-methyl-6-tert-isobutylphenol), 4,4'-isopropylidene-bis-(2-tert-butylphenol), 4,4'-sec-butylidenediphenol, 4-phenylphenol, 4,4'-isopropylidenediphenol(bisphenol A), 2,2'-methylene-bis(4-chlorophenol), hydroquinone, 4,4'-cyclohexylidenediphenol, novolak phenol resin and other phenol polymers.

Typical aromatic carboxylic acids which can be used as acceptor are: aromatic carboxylic acids, for example, benzoic acid, o-toluylic acid, m-toluylic acid, p-toluylic acid, p-tert-butylbenzoic acid, o-chlorobenzoic acid, p-chlorobenzoic acid, dichlorobenzoic acid, trichlorobenzoic acid, phthalic acid, isophthalic acid, terephthalic acid, 2-carboxybiphenyl, 3-carboxybiphenyl, m-hydroxybenzoic acid, p-hydroxybenzoic acid, anisic acid, p-ethoxybenzoic acid, p-propoxybenzoic acid, p-benzyloxybenzoic acid, p-phenoxybenzoic acid, gallic acid, anthranilic acid, m-aminobenzoic acid, p-aminobenzoic acid, phthalic acid monoamide, phthalic acid monoanilide, 3-isopropyl-4-hydroxybenzoic acid, 3-sec-butyl-4-hydroxybenzoic acid, 3-cyclohexyl-4-hydroxybenzoic acid, 3-phenyl-4-hydroxybenzoic acid, 3-benzyl-4-hydroxybenzoic acid, 3,5-dimethyl-4-hydroxybenzoic acid, 3,5-dichloro-4-hydroxybenzoic acid, trimellitic acid, pyromellitic acid, α-naphthoic acid, β-naphthoic acid, tetrachlorophthalic acid, 2,2'-dicarboxydiphenyl, salicylic acid, o-cresotinic acid, m-cresotinic acid, p-cresotinic acid, 3-ethylsalicylic acid, 4-ethylsalicylic acid, 3-isopropyl-salicylic acid, 3-sec-butylsalicylic acid, 5-sec-butyl-salicylic acid, 3-tert-butylsalicylic acid, 3-cyclohexyl-salicylic acid, 5-cyclohexylsalicylic acid, 3-phenyl-salicylic acid, 5-phenylsalicylic acid, 3-benzylsalicylic acid, 5-benzyl-salicylic acid, 5-tert-octylsalicylic acid, 3-(α-methylbenzyl)salicylic acid, 5-(α-methylbenzyl)-salicylic acid, 3-nonylsalicylic acid, 5-nonylsalicylic acid, 5-(α,α-dimethylbenzyl)-salicylic acid, 3-chlorosalicylic acid, 5-chlorosalicylic acid, 3-hydroxy-salicylic acid, 4-hydroxysalicylic acid, 5-hydroxy-salicylic acid, 6-hydroxy salicylic acid, 3-methoxysalicylic acid, 3-ethoxysalicylic acid, 4-methoxysalicylic acid, 5-methoxysalicylic acid, 5-benzyloxysalicylic acid, 5-octoxysalicylic acid, 3,5-dichlorosalicylic acid, 3-chloro-5-methylsalicylic acid, 3-chloro-5-ethylsalicylic acid, 3-chloro-5-isopropylsalicylic acid 3-chloro-5-tert-butylsalicylic acid, 3-chloro-5-cyclohexylsalicylic acid, 3-chloro-5-phenylsalicylic acid, 3-chloro-5-(α-methylbenzyl)salicylic acid, 3-chloro-5-(α,α-dimethylbenzyl)-salicylic acid, 3-chloro-5-chlorosalicylic acid, 3,5-dimethylsalicylic acid, 3-methyl-5-tert-butylsalicylic acid, 3-isopropyl-5-tert-butylsalicylic acid, 3-isopropyl-5-cyclohexylsalicylic acid, 3-isopropyl-5-(α-methylbenzyl)-salicylic acid, 3-isopropyl-5-(α,α-dimethylbenzyl)-salicylic acid, 3-sec-butyl-5-tert-butylsalicylic acid, 3-tert-butyl-5-cyclohexylsalicylic acid, 3-tert-butyl-5-(4-tert-butylphenyl)salicylic acid, 3-(4'-tert-octyl-phenyl)-5-tert-octylsalicylic acid, 3-{4'-(α,α-dimethyl-benzyl)-phenyl}-5-(α,α-dimethylbenzyl)salicylic acid, 3,5-di-α-methylbenzylsalicylic acid, 3,5-di-α,α-dimethylbenzyl-salicylic acid, 3-phenyl-5-α,α-dimethylbenzylsalicylic acid, 3-hydroxysalicylic acid, 1-hydroxy-2-carboxynaphthalene, 1-hydroxy-2-carboxy-4-isopropylnaphthalene, 1-hydroxy-2-carboxyl-7-cyclohexylnaphthalene, 5-(4'-hydroxybenzyl)salicylic acid, 5-(3'-carboxyl-4'-hydroxybenzyl)salicylic acid and 3-(α,α-dimethylbenzyl)-5-{3'-carboxyl-4'-hydroxy-5-(α,α-dimethylbenzyl)benzyl}salicylic acid.

Polymers of the above mentioned aromatic carboxylic acids with aldehydes or acetylene are also useful.

In addition, various polyvalent metal salts of the above mentioned phenolic compounds and aromatic carboxylic acids (including their polymers with aldehydes or acetylene) are also useful as acceptor. Among the polyvalent metals which can form such metallic salts like this there are included magnesium, aluminum, calcium, titanium, chromium, manganese, iron, cobalt, nickel, copper, zinc, silver, cadmium, tin and barium. Preferred metals are zinc, magnesium, aluminum and calcium.

Among useful inorganic acceptors there may be included activated clay, acid clay, attapulgite, bentonite, colloidal silica, aluminum silicate, magnesium silicate, zinc silicate, tin silicate, calcined kaolin and talc.

The above enumerated acceptors may be used either solely or in combination.

There is no special limitation about the composition ratio of the color former and the acceptor. In case where the combination of a basic colorless chromogenic material with an acceptor is used, the amount of the acceptor is larger than the amount of the colorless chromogenic material. Usually, the amount of the acceptor is within the range of 1 to 50 parts by weight, preferably, 4 to 10 parts by weight, per one part by weight of colorless chromogenic material.

The heat fusible material used in the present invention should have a melting point within the range of 60° C. to 200° C., preferably within the range of 65° C. to 120° C. and be capable of dissolving at least one of the color former and the acceptor therein when melted. Preferred heat fusible materials are those which do not react on any color former or acceptor to produce a color when brought into contact in a liquid phase with the latter. Among those heat fusible materials there may be included the following compounds:

| | m.p. (°C.) |
|---|---|
| 2,6-diisopropyl-naphthalene | 68 |
| 1,4,5-trimethyl-naphthalene | 63 |
| 2,3,5-trimethyl-naphthalene | 146 |
| 2,3,6-trimethyl-naphthalene | 102 |
| 1,5-dimethylnaphthalene | 82 |
| 1,8-dimethylnaphthalene | 65 |
| 2,3-dimethylnaphthalene | 105 |
| 2,6-dimethylnaphthalene | 113 |
| 2,7-dimethylnaphthalene | 98.5 |
| 1,2,3,4-tetramethylnaphthalene | 106 |
| 1,3,6,8-tetramethylnaphthalene | 85 |
| 1,4,5,8-tetramethylnaphthalene | 121 |
| 1,2,6,7-tetramethyl-4-isopropylnaphthalene | 103 |
| 1,3,6,7-tetramethyl-4-isopropylnaphthalene | 97 |
| 2,7-di-tert-butylnaphthalene | 104 |
| 1,2-di-o-tolylethane | 66 |
| α-methyl-4,4'-di-tert-butyl-diphenylmethane | 94 |
| 1,2-di-p-tolylethane | 82 |
| 1,2-bis(4-ethylphenyl)ethane | 69.8 |
| 1,1,2,2-tetramethyl-1,2-di-p-tolylethane | 159 |
| α,β-bis(tert-butylphenyl)ethane | 149 |
| 2,3-di-m-tolybutane | 97 |
| 2,3-dimethyl-2,3-di-p-tolylbutane | 158 |
| diphenyl-p-tolylmethane | 72 |
| diphenyl-o-tolylmethane | 82 |
| 1,2-dibenzylbenzene | 78 |
| 1,4-dibenzylbenzene | 86 |
| diphenyl-o-tolylmethane | 83 |
| 3,4-diphenylhexane | 92 |
| 1,2-bis(2,3-dimethylphenyl)ethane | 112 |
| 1,2-bis(2,4-dimethylphenyl)ethane | 72 |
| 1,2-bis(3,5-dimethylphenyl)ethane | 86 |
| 4'-methyl-4'-α-methyl-p-methylbenzyl-1,1-diphenylethane | 85 |
| bis(2,4,5-trimethylphenyl)methane | 98 |
| bis(2,4,6-trimethylphenyl)methane | 135 |
| 1,2-bis(2,4,6-trimethylphenyl)ethane | 118 |
| (2,3,5,6-tetramethylphenyl)-(4-tert-butylphenyl) methane | 117 |
| 1,6-bis(2,4,6-trimethylphenyl)hexane | 74 |
| bis(2,6-dimethyl-4-tert-butylphenyl)methane | 135 |
| 1,18-diphenyl-octadecane | 61 |
| 4,4'-dimethylbiphenyl | 121 |
| 2,4,6,2',4',6'-hexamethylbiphenyl | 101 |
| 4,4'-di-tert-butylbiphenyl | 128 |
| 2,6,2',6'-tetramethylbiphenyl | 67 |
| 1,3-terphenyl | 87 |
| stearic acid amide | 99 |
| stearic acid methylenebisamide | 140 |
| oleic acid amide | 68–74 |
| palmitic acid amide | 95–100 |
| physeteric acid amide | 65–72 |

-continued

| | m.p. (°C.) |
|---|---|
| coconut fatty acid amide | 85–90 |

In addition to the above, N-methylamide, anilide, β-naphthylamide, N-(2-hydroxyethyl)amide, N-(mercaptoethyl)amide, N-octadecylamide, phenylhydrazide and the like are also useful.

The above enumerated heat fusible materials may be used either solely or in combination at will.

The amount of the heat fusible material depends on the properties of the heat fusible material used and the combinations of color former and acceptors. However, generally speaking the amount of the heat fusible material would be within the range of 0.1 to 30 parts by weight, preferably 0.5 to 10 parts by weight, per one part by weight of the acceptor used.

The pigment particularly selected and used in the present invention should have an oil absorption within the range of 80 to 800 ml/100 g, preferably, within the range of 100 to 400 ml/100 g. The oil absorption value is defined in JIS (Japane Industrial Standard)K 5101 as follows:

$$G=(H/S)\times 100$$

wherein G is the oil absorption, H is the amount (ml) of linseed oil required for making the sample plasterizable and S is the weight (g) of the sample.

With the pigment having an oil absorption smaller than 80 ml/100 g the desired effect of substantially preventing adhesion of the smudges or tailings to the thermal head cannot be obtained, or otherwise the amount of the pigment must be so large that the record image density is lowered. The larger the oil absorption the more marvelous the effect of preventing adhesion of the smudges or tailings with use of the pigment in a reduced amount. It is desirable to use the pigment having a higher oil absorption in order to maintain the image density as desired. However, if the oil absorption of the pigment is excessively large, the amount of the binder required to be included in the color developing layer is extremely increased with the result that the image density is lowered. Accordingly, the oil absorption of the pigment used must be not larger than 800 ml/100 g.

Among the useful pigments having an oil sbsorption within the specified range there may be included the following compounds:

| | Oil absorption (ml/100g) |
|---|---|
| diatomaceous earth | 110–120 |
| calcined diatomaceous earth | 130–140 |
| flux-calcined diatomaceous earth | 120–160 |
| finely divided aluminum oxide anhydride | 80–250 |
| finely divided titanium oxide | 80–120 |
| white carbon | 80–300 |
| finely divided silicon dioxide anhydride | 100–300 |
| magnesium aluminosilicate | 300–400 |

The above enumerated compounds may be used either solely or in combination. Especially, pigments having —OH groups on the surface thereof such as finely divided silicon dioxide anhydride are preferred because, when coated with the acceptor and/or the heat fusible material, they are effective to prevent the coating composition for the color developing layer from incidental color development before coating and to keep the developed color on the color developing layer clear for a long time.

The oil absorption depends on various factors such as the shape and the diameter of the particles. It may be improved by a chemical or physical treatment so as to be within the above defined range.

According to the invention the oil absorptive pigment exists in the color developing layer in the form of finely divided particles each having a coating thereon. The coating on the pigment is formed of any of the color former, acceptor or the heat fusible material. The coating on the pigment may also include both the color former and the heat fusible material or both the acceptor and the heat fusible material. However, the coating on the pigment may not include both the color former and the acceptor because the color former will react with the acceptor to develop a color during the step of preparation of coated pigment particles, although it is allowed to separately prepare two kinds of oil absorptive pigment particles having different coatings thereon, one having a coating of the color former and the other having a coating of the acceptor and use them in a single color developing layer.

In order to prepare finely divided particles of the oil absorptive pigment each having the specified coating thereon any of the following manners may be preferably be utilized:

(1) The oil absorptive pigment is added to a melt of the coating material. After coating the obtained mass is pulverized into finely divided particles utilizing attritor, sand mill, ball mill or any other pulverizer.

(2) The oil absorptive pigment is added to a melt of the coating material. The melt mixture is then dispersed in water and cooled to obtain pigment particles having the coating material coated thereon.

(3) The coating material is dissolved in a suitable solvent. The oil absorptive pigment is admixed to the solution. After then the solvent is evaporated to obtain the pigment particles having the coating material coated thereon.

(4) A compound having a relatively low melting point is selected as the coating material. The material is dissolved in a hot water. The oil absorptive pigment is added to the solution. By cooling and evaporating water pigment particles having the coating material coated thereon are obtained.

The entire amount of any of the color former, the acceptor and the heat fusible material included in the color developing layer may be carried by the above mentioned oil absorptive pigment in the form of coating. Of course, it is also possible that only a part of any of those componets is carried by the oil absorptive pigment. In the latter case, the coating material carried by the oil absorptive pigment may be either the same as or different from that independently included in the color developing layer.

The amount of the coating material on the oil absorptive pigment may be within the range of about 5 to 500 parts by weight, preferably, 10 to 400 parts by weight per 100 parts by weight of the oil absorptive pigment.

The oil absorptive pigment coated with the above mentioned material may be used in the color developing layer in an amount within the range of about 5 to 80% by weight on dry basis, preferably, within the range of 10 to 65% by weight with respect to the total solid amount of the coating composition for forming the color developing layer.

In the coating composition for forming the color developing layer, in addition to the above mentioned essential components (a), (b), (c) and (d), a binder such as starch, modified starch, hydroxyethyl cellulose, methyl cellulose, carboxymethylcellulose, gelatin, casein, gum arabic, polyvinyl alcohol, salts of styrene-malein anhydride copolymer, styrene-butadiene copolymer emulsion, viny acetate-maleic anhydride copolymer emulsion, salts of polyacrylic acid may be used in an amount of 10 to 40% by weight, preferably 15 to 30% by weight with respect to the total solid amount.

In the coating composition various agents and additives may also be used. For example, in order to improve the color developing ability, enhance the light resistance and obtain matting effect inorganic metal compounds such as zinc oxide, magnesium oxide, calcium oxide, barium oxide, aluminum oxide, tin oxide, magnesium hydroxide, aluminum hydroxide, calcium hydroxide, zinc hydroxide, tin hydroxide, magnesium carbonate, zinc carbonate, calcium carbonate and inorganic pigments such as kaolin, clay, barium sulfate, zinc sulfide may be added in an amount of 0.1 to 5 parts by weight, preferably 0.2 to 2 parts by weight per one part of the acceptor used.

Further dispersing agents such as sodium dioctylsulfosuccinate, sodium dodecylbenzenesulfonate, sodium laurylalcoholsulfuric acid ester and metal salts of fatty acid, ultraviolet ray absorbing agents such as benzophenone derivatives and triazol derivatives, defoaming agents such as those of ester, ether, alcohol and silicon types, fluorescent dyes, coloring dyes may also be added to the coating composition.

The coating composition may also contain dispersion or emulsion including stearic acid, polyethylene, carnauba wax, paraffin wax, zinc stearate, calcium stearate, ester wax in order to prevent the heat-sensitive record material from being stuck in contact with stylus of a recording head.

The coating amount for forming the color developing layer may be changed within a wide range. Generally, it may be within the range of 1 to 20 $g/m^2$ on dry basis, preferably, within the range of 2 to 9 $g/m^2$.

The base sheet for the heat-sensitive record material may be of any known types. Also any known conventional techniques may be utilized for the formation of the color developing layer.

The heat-sensitive record material thus obtained according to the invention shows an excellent, stable, long time-continuous recordability without sacrificing the lowering of the record image density when applied at an extremely high speed operation in various information machines and instruments. It may be assumed this effect can be obtained owing to effective absorption by the specifically coated oil absorptive pigment in the color developing layer of the color developing materials in a molten state during the recording operation.

DETAILED DESCRIPTION OF THE PREFERRED EMBODIMENT

The following examples serve to illustrate the invention in more detail although the invention is not limited to the examples. Unless otherwise indicated, parts and % signify parts by weight and % by weight, respectively.

EXAMPLE 1

(1) Preparation of A liquid

The following composition was passed through a sand grinder.

| | |
|---|---|
| 2-phenylamino-3-methyl-6-(N-ethyl-p-tolyl)aminofluoran | 100 parts |
| stearic acid amide (m.p. 99° C.) | 200 parts |
| 5% aqueous solution of methyl-cellulose | 100 parts |
| water | 600 parts |

Pulverization was continued until an average particle size of 3 microns.

(2) Preparation of B liquid 100 parts of finely divided particles of silicon dioxide having an oil absorption of 300 ml/100 g was added to 200 parts of bisphenol A melted at 160° C. After completely mixing them the mixture was added into 1200 parts of water and pulverized with a homomixer under cooling to obtain a dispersion having an average particle size of 10 microns.

(3) Making a heat-sensitive record material

The following components were mixed to prepare a coating composition.

| | |
|---|---|
| A liquid | 1000 parts |
| B liquid | 1500 parts |
| finely divided particles of silicon dioxide having an oil absorption of 300ml/100g | 200 parts |
| 15% aqueous solution of polyvinyl alcohol | 650 parts |
| stylene-butadiene copolymer latex (having a solid content of 50%) | 200 parts |
| zinc stearate emulsion (having a solid content of 20%) | 500 parts |
| defoaming agent | a proper quantity |

The coating composition was coated on a base sheet of 49 g/m$^2$ in an amount of 7 g/m$^2$ on dry basis and the resultant sheet was treated with a super-calender to obtain a heat-sensitive record material.

EXAMPLE 2

(1) Preparation of A liquid

The following composition was passed through a sand grinder.

| | |
|---|---|
| 2-phenylamino-3-methyl-6-(N-ethyl-p-tolyl)aminofluoran | 100 parts |
| 30% aqueous solution of a sodium salt of styrene-acrylic acid copolymer | 10 parts |
| water | 300 parts |

Pulverization was continued until an average particle size of 2 microns.

(2) Preparation of B liquid 200 parts of bisphenol A was mixed with 200 parts of stearic acid amide. The mixture was melted at 120° C. 300 parts of silicon dioxide having an oil absorption of 200 ml/100 g was added to the melt. After completely mixing them the mixture was added into 2800 parts of water and pulverized with a homomixer under cooling to obtain a dispersion having an particle size of 8 microns.

(3) Making a heat-sensitive record material

The following components were mixed to prepare a coating composition.

| | |
|---|---|
| A liquid | 410 parts |
| B liquid | 3500 parts |
| 15% aqueous solution of polyvinyl alcohol | 650 parts |
| styrene-butadiene copolymer latex (having a solid content of 50%) | 100 parts |
| zinc stearate | 50 parts |

The coating composition was coated on a base sheet of 49 g/m$^2$ in an amount of 6 g/m$^2$ on dry basis and the resultant sheet was treated with a super-calender to obtain a heat-sensitive record material.

EXAMPLE 3

(1) Preparation of A liquid 100 parts of 2-phenylamino-3-methyl-6-(N-ethyl-p-tolyl)-aminofluoran was dissolved in 250 parts of chloroform. To the resultant solution, 150 parts of finely divided titanium dioxide having an oil absorption of 85 ml/100 g was added. After completely mixing them, chloroform was evaporated. Thus treated pigment was added into 1000 parts of water and pulverized with a homomixer to obtain a dispersion having an average particle size of 4 microns.

(2) Preparation of B liquid

The following composition was passed through a sand grinder.

| | |
|---|---|
| bisphenol A | 200 parts |
| stearic acid amide | 200 parts |
| 30% aqueous solution of a sodium salt of styrene-acrylic acid copolymer | 10 parts |
| water | 960 parts |

Pulverization was continued until an average particle size of 3 microns.

(3) Making a heat-sensitive record material

The following components were mixed to prepare a coating composition.

| | |
|---|---|
| A liquid | 1250 parts |
| B liquid | 1360 parts |
| finely divided particles of silicon dioxide having an oil absorption of 300ml/100g | 100 parts |
| styrene-butadiene copolymer latex (having a solid content of 50%) | 200 parts |
| 15% aqueous solution of polyvinyl alcohol | 650 parts |
| zinc stearate | 100 parts |
| deforming agent | 30 parts |

The coating composition was coated on a base sheet of 49 g/m$^2$ in an amount of 5 g/m$^2$ on dry basis and the resultant sheet was treated with a super-calender to obtain a heat-sensitive record material.

EXAMPLE 4

(1) Preparation of A liquid 100 parts of 3-(N-cyclohexyl-N-methylamino)-6-methyl-7-anilinofluoran was mixed with 200 parts of methylenebisstearylamide (m.p. 130° C.). The mixture was melted at 150° C. To the melt 300 parts of silicon dioxide having an oil absorption of 200 ml/100 g was added. The resultant mixture was slowly added into 2400 parts of water under vigorous stirring to obtain a treated pigment dispersion having an average particle size of 12 microns.

(2) Preparation of B liquid

The following composition was passed through a sand grinder.

| | |
|---|---|
| bisphenol A | 200 parts |
| 30% aqueous solution of a sodium salt of styrene-acrylic acid copolymer | 10 parts |
| water | 600 parts |

Pulverization was continued until an average particle size of 1.5 microns.

(3) Making a heat-sensitive record material

The following components were mixed to prepare a coating composition.

| | |
|---|---|
| A liquid | 3000 parts |
| B liquid | 800 parts |
| styrene-butadiene copolymer latex (having a solid content of 50%) | 200 parts |
| 15% aqueous solution of polyvinyl alcohol | 650 parts |
| zinc stearate | 50 parts |

The coating composition was coated on a base sheet of 49 g/m$^2$ in an amount of 6 g/m$^2$ on dry basis and the resultant sheet was treated with a super-calender to obtain a heat-sensitive record material.

EXAMPLE 5

200 parts of stearic acid amide was melted at 110° C. and 250 parts of aluminium oxide anhydride having an oil absorption of 125 ml/100 g was added into the melt to obtain a homogeneous mixture. The mixture was added into 1800 parts of water, pulverized with a homomixer and cooled to obtain a dispersion having an average particle size of 10 microns.

The following components were mixed with 2250 parts of the above dispersion to prepare a coating composition.

| | |
|---|---|
| A liquid used in Example 2 | 410 parts |
| B liquid used in Example 4 | 810 parts |
| 15% aqueous solution of polyvinyl alcohol | 650 parts |
| zinc stearate | 100 parts |
| deforming agent | 30 parts |

The coating composition was coated on a base sheet of 49 g/m$^2$ in the amount of 7 g/m$^2$ on dry basis and the resultant sheet was treated with a super-calender to obtain a heat-sensitive record material.

EXAMPLE 6

1000 parts of 20% aqueous emulsion of stearic acid amide was mixed with 350 parts of finely divided silicon dioxide having an oil absorption of 300 ml/100 g. The mixture was heated at 90° C. for 2 hours with stirring and then cooled on standing to obtain a dispersion.

The following components were mixed with 2750 parts of the above dispersion to prepare a coating composition.

| | |
|---|---|
| A liquid used in Example 2 | 410 parts |
| B liquid used in Example 4 | 810 parts |
| 15% aqueous solution of polyvinyl alcohol | 650 parts |
| styrene-butadiene copolymer latex (having a solid content of 50%) | 200 parts |
| zinc stearate | 100 parts |

The coating composition was coated on a base sheet of 49 g/m$^2$ in an amount of 7 g/m$^2$ on dry basis and the resultant sheet was treated with a super-calender to obtain a heat-sensitive record material.

CONTROL 1

(1) Preparation of A liquid

The following composition was passed through a sand grinder.

| | |
|---|---|
| 2-phenylamino-3-methyl-6-(N-methyl-p-tolyl)aminofluoran | 100 parts |
| stearic acid amide | 100 parts |
| dispersing agent | 5 parts |
| water | 480 parts |

Pulverization was continued until an average particle size of 2.8 microns.

(2) Preparation of B liquid

The following composition was passed through a sand grinder.

| | |
|---|---|
| bisphenol A | 200 parts |
| stearic acid amide | 100 parts |
| dispersing agent | 5 parts |
| water | 710 parts |

Pulverization was continued until an average particle size of 2.4 microns.

(3) Making a heat-sensitive record material

The following components were mixed to prepare a coating composition.

| | |
|---|---|
| A liquid | 685 parts |
| B liquid | 1015 parts |
| 20% aqueous emulsion of zinc stearate | 500 parts |
| silicon dioxide having a oil absorption of 200ml/100g | 300 parts |
| 15% aqueous solution of polyvinyl alcohol | 650 parts |
| styrene-butadiene copolymer latex (having a solid content of 50%) | 200 parts |

The coating composition was coated on a base sheet of 49 g/m$^2$ in an amount of 7 g/m$^2$ on dry basis and the resultant sheet was treated with a super-calender to obtain a heat-sensitive record material.

CONTROL 2

200 parts of stearic acid amide was melted at 110° C. 200 parts of kaolin having an oil absorption of 40 ml/100 g was added to the melt. After completely mixing them the mixture was added to 1200 parts of water, pulverized with a homomixer and cooled to obtain a dispersion having an average particle size of 5 microns.

The following components were mixed to 1400 parts of the above dispersion to prepare a coating composition.

| | |
|---|---|
| A liquid used in Example 2 | 410 parts |
| B liquid used in Example 4 | 810 parts |
| 15% aqueous solution of polyvinyl alcohol | 650 parts |
| styrene-butadiene copolymer latex (having a solid content of 50%) | 100 parts |

The coating composition was coated on a base sheet of 49 g/m$^2$ in an amount of 6 g/m$^2$ on dry basis and the resultant sheet was treated with a super-calender to obtain a heat-sensitive record material.

In order to determine the properties of thus obtained eight heat-sensitive record materials, all-mark image was recorded on each record material with the use of a practical heat-sensitive facsimile (EF-11 type manufactured by Matsushita Denso-kiki Kabushiki Kaisha, Japan), for 2 minutes. The smudges adherent to the thermal head were checked with the eye. The color densities of the obtained images and the background were measured by Macbeth reflex densitometer RD-100R (manufactured by Macbeth Corporation, USA) with the use of an amber filter. The test results are shown in Table 1.

TABLE 1

| | Adhesion of smudges | Recorded image density | Background density |
|---|---|---|---|
| Example 1 | | 1.02 | 0.12 |
| Example 2 | | 1.00 | 0.10 |
| Example 3 | | 1.14 | 0.12 |
| Example 4 | | 1.00 | 0.10 |
| Example 5 | | 1.03 | 0.11 |
| Example 6 | | 1.00 | 0.10 |
| Control 1 | Δ | 1.03 | 0.10 |
| Control 2 | X | 1.05 | 0.10 |

Note:
:No smudge was found.
Δ:Some smudges were found on the top of the thermal head.
X:Many smudges were found on the top of the thermal head.

As shown in Table 1, the heat-sensitive record materials obtained in Examples improved in preventing an adhesion of smudges to the thermal head without a drop of record sensitivity and had a superior continuous recordability.

What is claimed is:

1. In a heat-sensitive record material comprising a base sheet and a color developing layer formed on at least one surface of said base sheet, said color developing layer comprising
   (a) electron donating color forming material,
   (b) acceptor which is reactive with said color forming material to develop a color,
   (c) a heat fusible material having a melting point within the range of 60° C. to 200° C., and
   (d) oil absorptive pigment having an oil absorption within the range of between 80 and 800 ml/100 g, the improvement in said pigment existing in said color developing layer in the form of finely divided particles each having a coating thereon, said coating being formed of said acceptor or said heat fusible material.

2. A heat-sensitive record material as defined in claim 1, in which said electron donating color forming material is colorless chromogenic material.

3. A heat-sensitive record material as defined in claim 1, in which the coating amount of the coating material on said oil absorptive pigment within the range of 5 to 500 parts by weight per 100 parts by weight of said oil absorptive pigment.

4. A heat-sensitive record material as defined in claim 3, in which said oil absorptive pigment is used in said color developing layer in an amount of about 5 to 80% by weight on dry basis with respect to the total solid amount of said color developing layer.

5. In a heat-sensitive record material comprising a base sheet and a color developing layer formed on at least one surface of said base sheet, said color developing layer comprising
   (a) electron donating color forming material,
   (b) acceptor which is reactive with said color forming material to develop a color,
   (c) a heat fusible material having a melting point within the range of 60° C. to 200° C., and
   (d) oil absorptive pigment having an oil absorption within the range of between 80 and 800 ml/100 g, the improvement in said pigment existing in said color developing layer in the form of finely divided particles each having a coating thereon, said coating on said oil absorptive pigment including both said acceptor and said heat fusible material.

6. A heat-sensitive record material as defined in claim 5, in which the coating amount of the coating material on said oil absorptive pigment within the range of 5 to 500 parts by weight per 100 parts by weight of said oil absorptive pigment.

7. A heat-sensitive record material as defined in claim 6, in which said oil absorptive pigment is used in said color developing layer in an amount of about 5 to 80% by weight on dry basis with respect to the total solid amount of said color developing layer.

* * * * *